US008055176B2

(12) United States Patent
Kuharik

(10) Patent No.: US 8,055,176 B2
(45) Date of Patent: Nov. 8, 2011

(54) HEAT ROLLER FOR ELECTROPHOTOGRAPHIC IMAGE FORMING DEVICE

(75) Inventor: Christopher Michael Kuharik, Georgetown, KY (US)

(73) Assignee: Lexmark International, Inc., Lexington, KY (US)

( * ) Notice: Subject to any disclaimer, the term of this patent is extended or adjusted under 35 U.S.C. 154(b) by 356 days.

(21) Appl. No.: 12/329,818

(22) Filed: Dec. 8, 2008

(65) Prior Publication Data

US 2010/0143009 A1 Jun. 10, 2010

(51) Int. Cl.
*G03G 15/20* (2006.01)

(52) U.S. Cl. ..... 399/333

(58) Field of Classification Search ..... 399/333
See application file for complete search history.

(56) References Cited

U.S. PATENT DOCUMENTS

| | | | | |
|---|---|---|---|---|
| 6,940,045 | B2 | 9/2005 | Sanpei et al. | |
| 7,024,146 | B2 | 4/2006 | Kim et al. | |
| 7,026,578 | B2 | 4/2006 | Mori et al. | |
| 7,046,951 | B2 | 5/2006 | Kim et al. | |
| 7,248,827 | B2 | 7/2007 | Cho et al. | |
| 2007/0054077 | A1 * | 3/2007 | Barrese et al. | 428/35.7 |
| 2008/0112740 | A1 * | 5/2008 | Kim | 399/333 |

* cited by examiner

*Primary Examiner* — Hoang Ngo

(57) ABSTRACT

A heat roller for an electrophotographic device comprised of an internal tube inside an insulating layer wherein a heating element having a resistance member is fixed to the outer surface of the insulating layer by depositing the resistance member onto a polyimide film applied to the insulating layer, depositing the resistance member directly to insulating layer, or embedding the resistance member in the insulating layer. Alternatively, the heating element having a resistance member is fixed to the outer surface of the internal tube by depositing the resistance member onto a polyimide film applied to the internal tube, thereby eliminating the insulating layer. An elastomer layer of predetermined thickness is overmolded to the outer surface of the insulating layer or the internal tube and an outside surface is applied to the outer surface of the elastomer layer wherein a toner image is fused on paper from the outside surface by heat transferred from the heating element.

25 Claims, 2 Drawing Sheets

HEAT ROLLER FOR ELECTROPHOTOGRAPHIC IMAGE FORMING DEVICE

CROSS REFERENCES TO RELATED APPLICATIONS

None.

BACKGROUND

1. Field of the Invention

The present invention relates generally to image forming devices, and more particularly, to a heat roller in a fuser of an electrophotographic image forming device.

2. Description of the Related Art

An image forming machine, such as a printer, copier, fax machine, all-in-one device or multifunctional device, typically includes a heating device, such as a fuser, to fix a developing agent, such as toner, to a media sheet. Most commonly, this is achieved with a two-roll fuser, wherein two rollers are coated with some sort of compliant material and both are coated with a release agent such as a Teflon® sleeve are brought into contact with some force, and the paper is fed between them. One roller is driven and one roller is idling, and one or both rollers is/are heated internally by means of a radiant heater, or sometimes inductive heating. Roll fusers are a well developed technology, frequently yielding good performance in terms of speed and quality of the fused image. The drawback is they have a high thermal mass, which translates to long warm-up times and higher energy consumption at startup. An alternate method of fusing is belt fusing. In a belt fusing system, a long, thin, flat heater, often made of ceramic, is supported by a rigid frame. A thin cylindrical metal tube, coated with a thin layer of compliant material and a release agent, encases the heater and frame assembly. The belt assembly is forcibly brought into contact with a driven compliant roll similar to that found in a two-roll fuser, and the paper is fed between the belt and roll. The belt slides over the heater surface by means of a lubricant. The minimal thermal circuit between the belt and the heater, and the low thermal mass of the belt cause these systems to reach operating temperature very rapidly, resulting in little energy wasted. However, the drawback in these belt fusing systems is that they inherently require high torque to drive them, due to the sliding friction between the belt and the heater.

Previous attempts have been made in the prior art to combine the best aspects of both types of fusing systems—the low thermal mass and minimal thermal circuit of a belt fuser, with the low friction and robust design of a two-roll fuser by the marriage of a resistance heater with a fusing roll. There are similar devices in industry, notably U.S. Pat. Nos. 6,940,045 to Sanpei et al., 7,026,578 to Mori et al., 7,024,146 to Kim et al., 7,046,951 to Kim et al., and 7,248,827 to Cho et. al. All consist of a metallic outer sleeve, a resistance heater, and a metallic inner core. All of these devices have a solid aluminum outer core, which carries with it increased thermal mass and correspondingly hampers warm-up time. All of these devices also focus on a common assembly process in that they are built from the outside in, by sliding the heater into the outer shell and locking the assembly together by fluid-forming the inner core resulting in the need for larger bearings which are more expensive than smaller bearings.

Thus, there is still a need for an innovation that will further reduce thermal mass and increase warm-up time and overcome problems encountered in the common assembly process.

SUMMARY OF THE INVENTION

The present invention meets this need by providing an innovation that is a heat roller with low thermal mass and minimal thermal circuit similar to that of a belt fuser but also with low friction and robust design similar to a two-roll fuser. The present invention advances on the resistance heated roll concepts in the prior art by dispensing with the outer aluminum core altogether, thereby reducing thermal mass and placing the heater closer to the surface of the roll where it's most useful. It is also characterized by a different manufacturing process, building from the inside out rather than the outside in to permit the use of a small diameter journal and bearings for the roller to run on in order to reduce costs of manufacturing.

Accordingly, in an aspect of the present invention, a heat roller for an electrophotographic imaging device includes an internal tube; a sheet-like heating element having a resistance member deposited onto the outer surface of a cylindrical polyimide film strip; a compliant cylindrical insulating layer wherein the inner surface of the polyimide film strip is adhered to the outer surface of the insulating layer and the inner surface of the insulating layer is adhered to the outer surface of the internal tube; a cylindrical elastomer layer of predetermined thickness overmolded to the outer surface of the polyimide film strip; and a cylindrical outside surface applied to the outer surface of the elastomer layer wherein a toner image is fused on paper from the outside surface by heat transferred from the heating element.

In another aspect of the present invention, a heat roller for an electrophotographic imaging device includes an internal tube; a rigid cylindrical insulating layer wherein the inner surface of the insulating layer is adhered to the outer surface of the internal tube; a heating element having a resistance member fixed to the insulating layer proximate to the outer surface thereof; a cylindrical elastomer layer of a predetermined thickness overmolded to the outer surface of the insulating layer; and a cylindrical outside surface applied to the outer surface of the elastomer layer wherein a toner image is fused on paper from the outside surface by heat transferred from the heating element.

In a further aspect of the present invention, a heat roller for an electrophotographic imaging device includes an internal tube; a heating element having a resistance member fixed to the internal tube proximate to the outer surface thereof; a cylindrical elastomer layer of predetermined thickness overmolded to the outer surface of the internal tube; and a cylindrical outside surface applied to the outer surface of the elastomer layer wherein a toner image is fused on paper from the outside surface by heat transferred from the heating element.

BRIEF DESCRIPTION OF THE DRAWINGS

Figure 1:
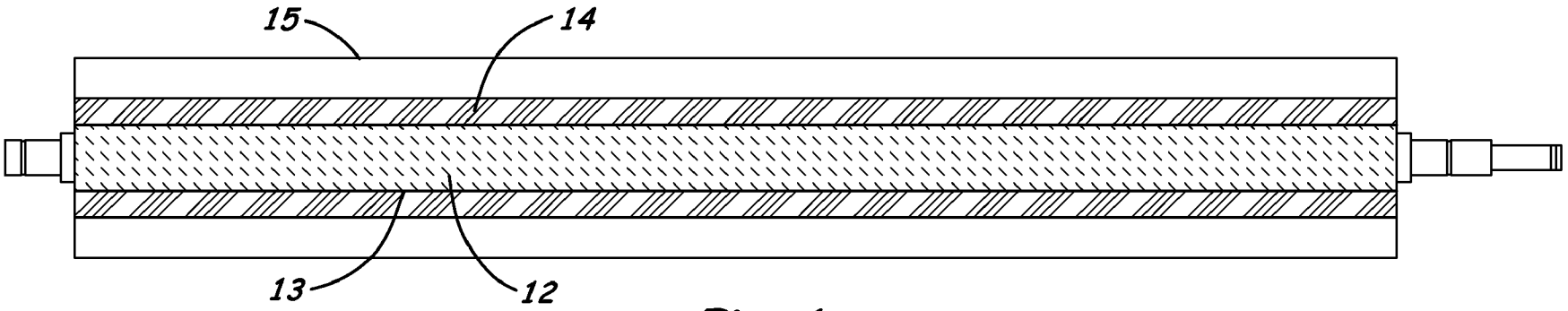

Having thus described the invention in general terms, reference will now be made to the accompanying drawings, which are not necessarily drawn to scale, and wherein:

FIG. 1 is a profile cross-sectional view schematically illustrating a fusing roller device according to the present invention.

Figure 2:
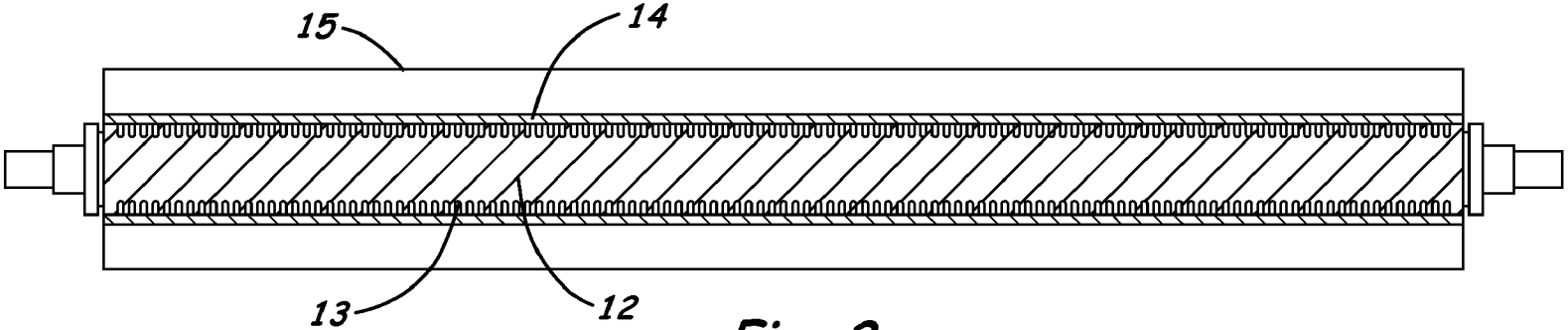

FIG. 2 is a profile cross-sectional view schematically illustrating an alternative fusing roller device according to the present invention.

Figure 3:
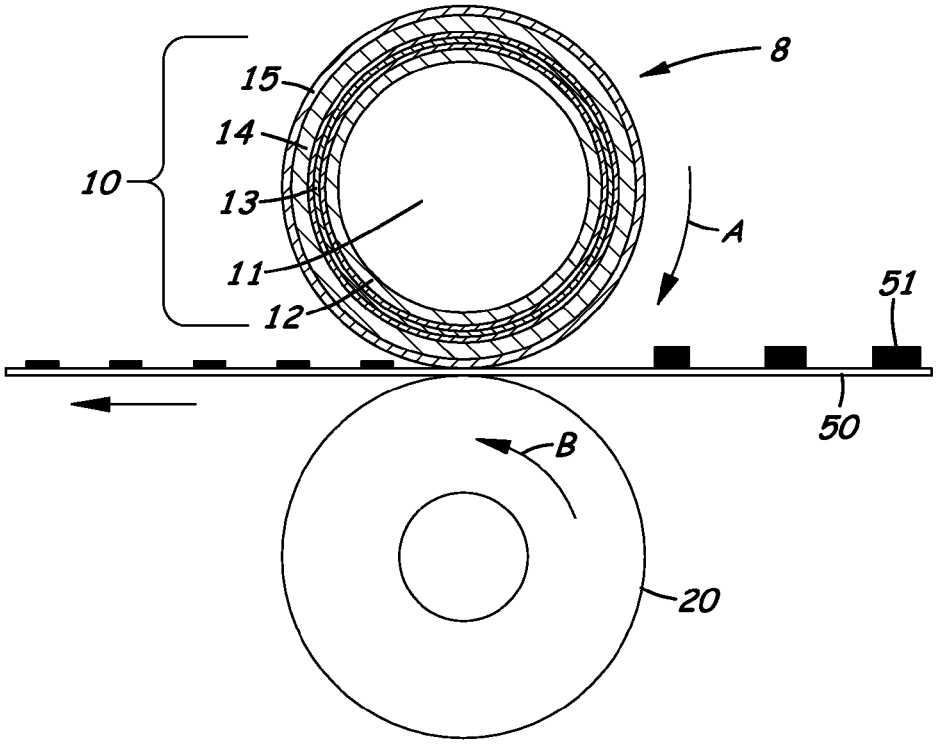

FIG. 3 is a schematic vertical cross-sectional view of a fusing portion of an image forming apparatus using the fusing roller device according to the present invention.

Figure 4:
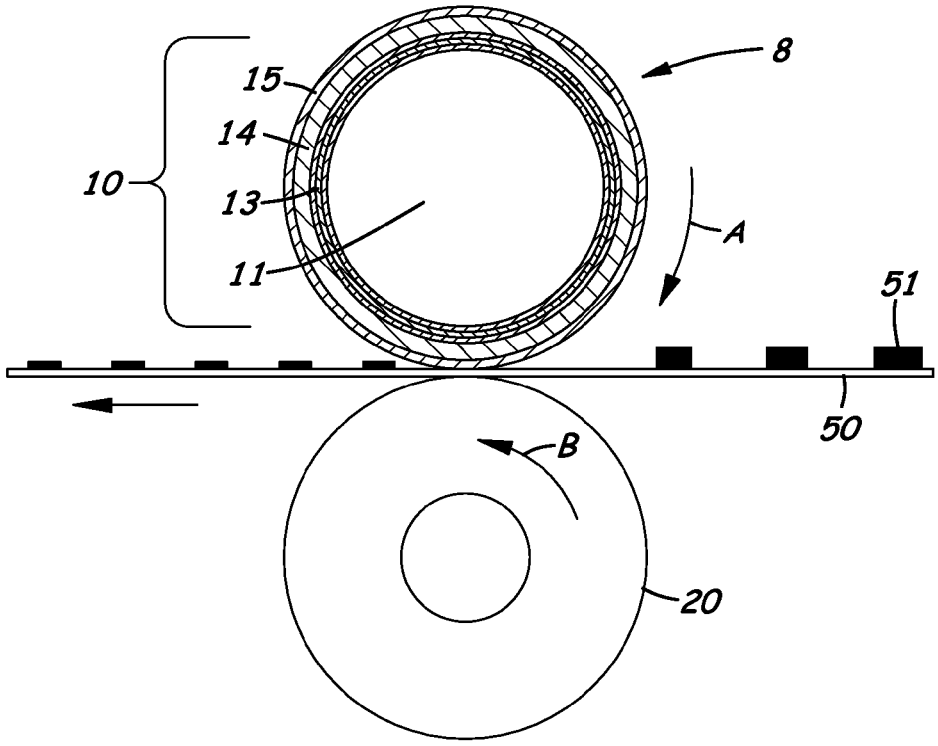

FIG. 4 is a schematic vertical cross-sectional view of the fusing portion of the image forming apparatus using the alternative fusing roller device according to the present invention.

DETAILED DESCRIPTION

The present invention now will be described more fully hereinafter with reference to the accompanying drawings, in which some, but not all embodiments of the invention are shown. Indeed, the invention may be embodied in many different forms and should not be construed as limited to the embodiments set forth herein; rather, these embodiments are provided so that this disclosure will satisfy applicable legal requirements. Like numerals refer to like elements throughout the views.

Referring now to FIG. 1, a fusing roller device includes an internal tube (not shown) that is formed from steel or extruded aluminum. Adhered to the outside surface of the internal tube 11 is an insulating layer 12. In a preferred embodiment, the insulating layer 12 is made from a compliant material such as silicone elastomer, high temperature foam, SOLT, or microballoon. Use of a compliant insulating layer 12 is preferred as it maximizes the possible nip (contact area between rolls), as well as help to create a flat nip which will help with media curl and media output stacking. Alternatively, the insulating layer 12 can be made from a hard, insulative high temperature plastic such as Poly-ether-ether-ketone (PEEK), Liquid Crystal Polymer or PAI. The plastic may be foamed, or made using Mucell process, or have hollow glass spheres added to improve its insulative properties and reduce thermal mass. Adhered to the outside surface of the insulating layer 12 is a thin-resistance heater 13. In a preferred embodiment the thin-resistance heater traces are deposited on the outer surface of a thin polyimide tube and the thin polyimide tube is bonded or overmolded to the insulating layer 12. Alternatively, if a hard insulative core material is used for the insulating layer 12, the thin-resistance heater traces can be directly deposited onto the insulating layer 12 or a resistance wire (not shown) can be embedded in spiral groove on the outer surface of the insulating layer 12. An elastomer layer 14 is overmolded to the outside surface of either the polyimide layer containing the thin-resistance heater 13 or the insulating layer 12 containing the thin-resistance heater 13. The elastomer layer 14 is made using a low thermal resistance silicone elastomer material such as Shin-etsu 2280 which provides the compliance necessary for color print quality, evenly distributes the heat from the traces of the heater, and further electrically isolates the heater traces for safety. The required thickness of the elastomer layer 14 is predetermined empirically. An outside surface 15 is applied to the outer surface of the elastomer layer 14 for release of the printed image. The outer surface 15 can be a PFA sleeve or can be a spray-coated surface.

Referring now to FIG. 2, an alternative embodiment of a fusing roller device includes an internal tube 11 that is formed from an injection molded core of high-temperature bearing plastic such as PEEK, Liquid Crystal Polymer or PAI. The plastic may be foamed or made using Mucell process, or have hollow glass spheres. Adhered to the outside surface of the internal tube 11 is a thin-resistance heater 13. In a preferred embodiment the thin-resistance heater traces are deposited on the outer surface of a thin polyimide tube and the thin polyimide tube is bonded or overmolded to the internal tube 11. Alternatively, the thin-resistance heater traces can be directly deposited onto the insulating layer 12 or a resistance wire (not shown) can be embedded in spiral groove on the outer surface of the insulating layer 12. An elastomer layer 14 is overmolded to the outside surface of either the polyimide layer containing the thin-resistance heater 13 or the insulating layer 12 containing the thin-resistance heater 13. The elastomer layer 14 is made using a low thermal resistance silicone material such as Shin-etsu 2280 which provides the compliance necessary for color print quality, evenly distributes the heat form the traces of the heater, and further electrically isolates the heater traces for safety. The required thickness of the elastomer layer 14 is predetermined empirically. An outside surface 15 is applied to the outer surface of the elastomer layer 14 for release of the printed image. The outer surface 15 can be a PFA sleeve or can be a spray-coated surface.

Turning to FIG. 3, a fusing portion 8 for an electrophotographic image forming device using a fusing roller device according to an embodiment of the present invention includes a fusing roller device 10, which rotates in direction shown by arrow A, and a pressure roller 20 installed opposite to the fusing roller device 10. Paper 50 is placed between fusing roller device 10 and the pressure roller 20, which contacts the roller device 10 and rotates in a direction shown by arrow B. The fusing roller device 10 includes internal tube 11, insulating layer 12, a thin resistance heater 13, and elastomer layer 14 and outside surface 15.

Turning to FIG. 4, an alternative embodiment of the present invention is illustrated by a fusing portion 8 for an electrophotographic image forming device using a fusing roller device according to an embodiment of the present invention includes a fusing roller device 10, which rotates in direction shown by arrow A, and a pressure roller 20 installed opposite to the fusing roller device 10. Paper 50 is placed between fusing roller device 10 and the pressure roller 20, which contacts the roller device 10 and rotates in a direction shown by arrow B. The fusing roller device 10 includes internal tube 11, a thin resistance heater 13, and elastomer layer 14 and outside surface 15.

The foregoing description of several embodiments of the invention has been presented for purposes of illustration. It is not intended to be exhaustive or to limit the invention to the precise forms disclosed, and obviously many modifications and variations are possible in light of the above teaching. It is intended that the scope of the invention be defined by the claims appended hereto.

What is claimed is:

1. A heat roller for an electrophotographic imaging device, said heat roller comprising;

an internal tube;

an insulating layer having an inner surface adhered to an outer surface of the internal tube;

a heating element adhered to an outer surface of the insulating layer, said heating element having a polyimide member and a resistance member deposited onto an outer surface of the polyimide member;

an elastomer layer of predetermined thickness overmolded to the outer surface of the polyimide member; and an outside surface applied to an outer surface of the elastomer layer, wherein a toner image is fused on a paper from the outside surface by heat transferred from the heating element.

2. The heat roller of claim 1 wherein said internal tube is formed from aluminum.

3. The heat roller of claim 1 wherein said internal tube is formed from steel.

4. The heat roller of claim 1 wherein said internal tube is formed from injection molded plastic.

5. The heat roller of claim 1 wherein said insulating layer is comprised of a compliant material.

6. The heat roller of claim 5 wherein said compliant material of said insulating layer is selected from the group consisting of silicone elastomer, foam, SOLT, microballoon or other suitable material of compliance similar to silicone elastomer.

7. The heat roller of claim 1, wherein said polyimide member is a polyimide tube bonded or overmolded to the outer surface of the insulating layer.

8. The heat roller of claim 1, wherein said polyimide member comprises a polyimide film strip wrapped substantially around said insulating layer and bonded thereto.

9. A heat roller for an electrophotographic imaging device, said heat roller comprising an internal tube;

a rigid insulating layer adhered to an outer surface of the internal tube;

a heating element having a resistance member directly fixed to the rigid insulating layer proximate to an outer surface thereof;

an elastomer layer of a predetermined thickness overmolded to the outer surface of the insulating layer; and an outside surface applied to an outer surface of the elastomer layer, wherein a toner image is fused on a paper from the outside surface by heat transferred from the heating element.

10. The heat roller of claim 9 wherein said internal tube is formed from aluminum.

11. The heat roller of claim 9 wherein said internal tube is formed from steel.

12. The heat roller of claim 9 wherein said rigid insulating layer is comprised of a relatively hard, insulative, high temperature plastic.

13. The heat roller of claim 12 wherein said hard, insulative, high temperature plastic is selected from the group consisting of PEEK, Liquid Crystal Polymer, PAI or other suitable plastic of rigidity and temperature resistance similar to the group.

14. The heat roller of claim 12 wherein said relatively hard, insulative, high temperature plastic is a foamed plastic.

15. The heat roller of claim 12 wherein said relatively hard, insulative, high temperature plastic is a Mucell° plastic.

16. The heat roller of claim 12 wherein said relatively hard, insulative, high temperature plastic includes hollow glass spheres.

17. The heat roller of claim 9 wherein said resistance member comprises resistive heater traces directly deposited on the outer surface of the rigid insulating layer.

18. The heat roller of claim 9 wherein said resistance member is a resistance wire substantially embedded in a substantially spiral-shaped groove defined on the outer surface of the rigid insulating layer.

19. A heat roller for an electrophotographic imaging device, said heat roller comprising;

an internal tube formed from plastic;

a heating element having a resistance member directly fixed to the internal tube proximate to an outer surface thereof;

an elastomer layer of predetermined thickness overmolded to the outer surface of the internal tube; and an outside surface applied to an outer surface of the elastomer layer, wherein a toner image is fused on a paper from the outside surface by a heat transferred from the heating element.

20. The heat roller of claim 19 wherein said plastic of said internal tube is injection molded plastic selected from the group consisting of PEEK, Liquid Crystal Polymer, PAI, or other suitable plastic of rigidity and temperature resistance similar to the group.

21. The heat roller of claim 19 wherein said internal tube comprises an injection molded foamed plastic.

22. The heat roller of claim 19 wherein said internal tube comprises an injection molded Mucell® plastic.

23. The heat roller of claim 19 wherein said plastic internal tube includes hollow glass spheres.

24. The heat roller of claim 19 wherein said resistance member comprises thin-resistance heater traces directly deposited on the outer surface of the internal tube.

25. The heat roller of claim 19 wherein said resistance member is a resistance wire substantially embedded in a substantially spiral-shaped groove defined on the outer surface of said internal tube.

* * * * *